US007959487B2

(12) United States Patent
Simpson

(10) Patent No.: US 7,959,487 B2
(45) Date of Patent: Jun. 14, 2011

(54) BRASSIERE

(75) Inventor: Elisabeth Simpson, Hong Kong (CN)

(73) Assignee: Triumph Intertrade AG, Bad Zurzach (CH)

( * ) Notice: Subject to any disclaimer, the term of this patent is extended or adjusted under 35 U.S.C. 154(b) by 438 days.

(21) Appl. No.: 12/116,217

(22) Filed: May 7, 2008

(65) Prior Publication Data

US 2008/0280532 A1 Nov. 13, 2008

(30) Foreign Application Priority Data

May 7, 2007 (DE) ..... 20 2007 006 705 U

(51) Int. Cl.
*A41C 3/00* (2006.01)

(52) U.S. Cl. ..... 450/39; 450/92

(58) Field of Classification Search ..... 450/1, 3, 450/4, 7, 8, 92, 93, 39, 40, 60, 74–76; 2/243.1; 66/176, 177, 172 R, 175, 196, 197
See application file for complete search history.

(56) References Cited

U.S. PATENT DOCUMENTS

| | | | | |
|---|---|---|---|---|
| 5,660,577 | A * | 8/1997 | Modena | 450/86 |
| 5,916,829 | A * | 6/1999 | Girard et al. | 442/244 |
| 6,000,994 | A * | 12/1999 | Salotto | 450/92 |
| 6,180,178 | B1 * | 1/2001 | Vogt | 427/389.9 |
| 6,238,266 | B1 * | 5/2001 | Vogt | 450/19 |
| 6,287,168 | B1 * | 9/2001 | Rabinowicz | 450/75 |
| 6,837,771 | B2 * | 1/2005 | Falla | 450/39 |
| 7,192,332 | B2 * | 3/2007 | Liu | 450/39 |
| 7,407,427 | B2 * | 8/2008 | Liu | 450/39 |
| 7,563,152 | B2 * | 7/2009 | Liu | 450/39 |
| 7,682,219 | B2 * | 3/2010 | Falla | 450/92 |
| 2010/0144242 | A1 * | 6/2010 | Allen et al. | 450/39 |

* cited by examiner

*Primary Examiner* — Gloria Hale
(74) *Attorney, Agent, or Firm* — Muncy, Geissler, Olds & Lowe, PLLC

(57) ABSTRACT

A brassiere is provided with a front piece forming the breast cups and with two side pieces extending around the upper body of an individual wearing the brassiere and which can be connected in the back area of the wearer. Shoulder straps extend from the breast cups to the back parts of the side pieces. At least part of the edges of the brassiere are folded over to form the marginal edge and fixed in this position by an adhesive layer is arranged between the folded-over edge part and the textile layer of the brassiere that faces it.

15 Claims, 2 Drawing Sheets

Fig. 2
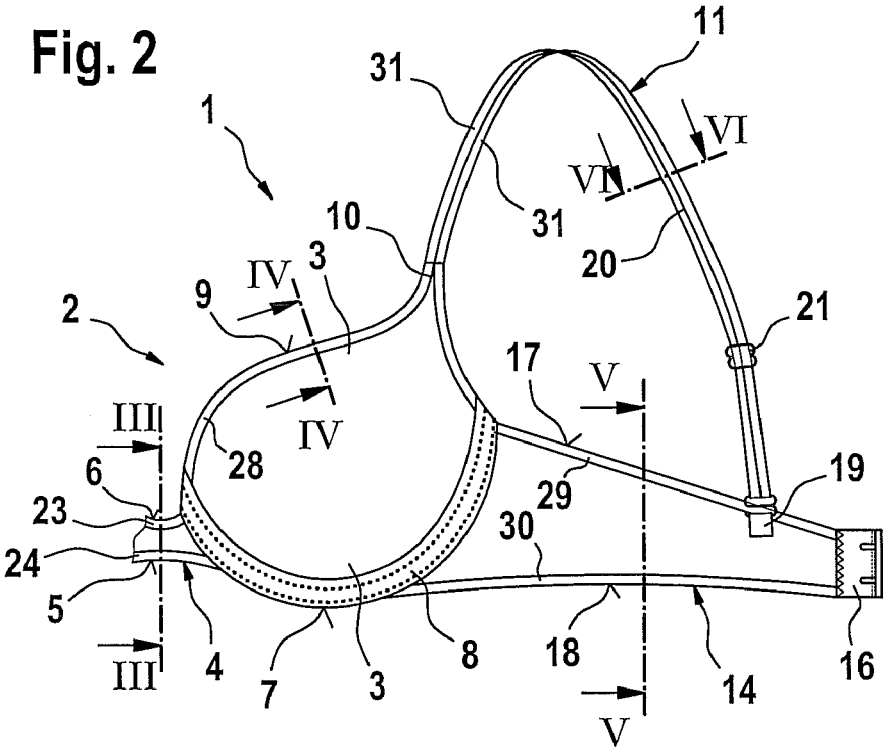
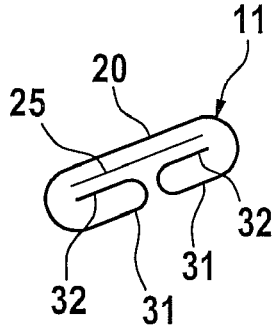
Fig. 6
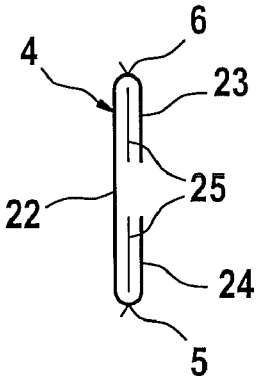
Fig. 3
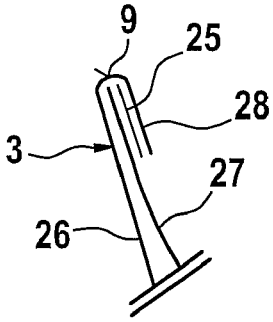
Fig. 4
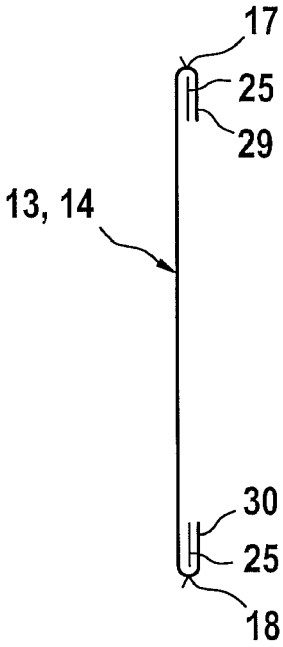
Fig. 5

BRASSIERE

This nonprovisional application claims priority under 35 U.S.C. §119(a) to German Patent Application No. 20 2007 006 705.4, which was filed in Germany on May 7, 2007, and which is herein incorporated by reference.

BACKGROUND OF THE INVENTION

1. Field of the Invention

The invention relates to a brassiere.

2. Description of the Background Art

Brassieres of this class are commonly known, and are available in a multitude of variations all over the world. They are constructed of a front section, which essentially comprises two bra cups, which come in a wide variety of different shapes, and which are connected by a center part. Connected to the respective outer lateral edges of the front section is a side panel, the free ends of which can be joined at the back of the person wearing the brassiere with a back closure. The side panels can be sewn to the front section, or they can be of one piece altogether. For additional support, shoulder straps can be provided, which connect the bra cups with the side panels in the rear. The essential function of such brassieres is bearing the weight, supporting, and shaping the bust. At the same time, such brassieres are expected to provide high wearing comfort and an appealing look. The objective is thereby a brassiere that is virtually unnoticeable, both optically and with respect to wearing comfort.

Generally, brassieres of this kind have support bands, piping, or trimming ribbons along their edges, which are attached with zigzag seams. As a result of the accumulation of a plurality of fabric layers and seams on top of each other associated therewith, such brassieres have a certain thickness in this area. Especially when worn under tight-fitting clothes, for example, tops and the like, these peripheral areas have a tendency to stand out against the outer wear, which diminishes the aesthetic appearance. This is particularly true for the upper edges of the bra cups as well as the side panels. In addition, such a thickness in the side panels causes difficulties when handling the strap buckle to adjust the length of the shoulder strap.

Furthermore, the seams in the border area of brassieres come in direct contact with the skin of the person wearing the brassiere, which can lead to skin irritation, especially with people having sensitive skin, thus substantially reducing the wearing comfort. This is particularly true for the seams in the area of the side panels because a well-fitting brassiere requires an appropriate tightness of the side panels, whereby the side panels are pressed against the upper body of the person wearing the brassiere

SUMMARY OF THE INVENTION

In view of this background, it is an object of the invention to further improve conventional brassieres with respect to their wearing comfort and their overall look.

Constructing the border areas of a brassiere in accordance with the invention allows a very thin and light design of the brassiere. On the one hand, this is due to the fact that merely two textile layers determine the thickness of the brassiere in this area. On the other hand, this effect is also obtained by the elimination of seams in the border area. Both facts contribute to forming border zones, which in contact with the outer wear and the skin are completely smooth and skin-hugging, thus allowing brassieres, which are barely noticeable under the outer wear, and are thus particularly well suited to be worn under tight-fitting outer wear. Furthermore, brassieres of the instant invention provide extremely high wearing comfort.

In a first general embodiment of the invention, an adhesive layer is provided for fixing the border foldover into position, which can be applied directly to the inner side of the border foldover, for example. Suitable adhesives are polyutheranes, polyolefins, or thermoplastic elastomers. These can be applied mechanically to the desired areas by way of spraying, rolling, or pressing.

However, in contrast thereto, an embodiment of the invention is preferred, whereby the adhesive layer is formed by adhesive tapes, which are beneficially supplied with a thermo-sensitive adhesive. This embodiment of the invention simplifies the production procedure considerably.

In a beneficial further development of this embodiment, the adhesive tapes have elastic properties so that they have a dual function, namely, fixing the border foldover into position on the one hand, and on the other hand making sure that the brassiere securely stays in place on the upper body of the person wearing it, which in conventional brassieres would require separate elastic tapes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 2 is a view of the interior of one-half of the brassiere illustrated in FIG. 1;

FIG. 3 is a cross section of the brassiere illustrated in FIG. 2, along the line III-III;

FIG. 4 is a cross section of the brassiere illustrated in FIG. 2, along the line IV-IV;

FIG. 5 is a cross section of the brassiere illustrated in FIG. 2, along the line V-V; and FIG. 6 is a cross section of the brassiere illustrated in FIG. 2, along the line VI-VI.

DETAILED DESCRIPTION

Figure 1:
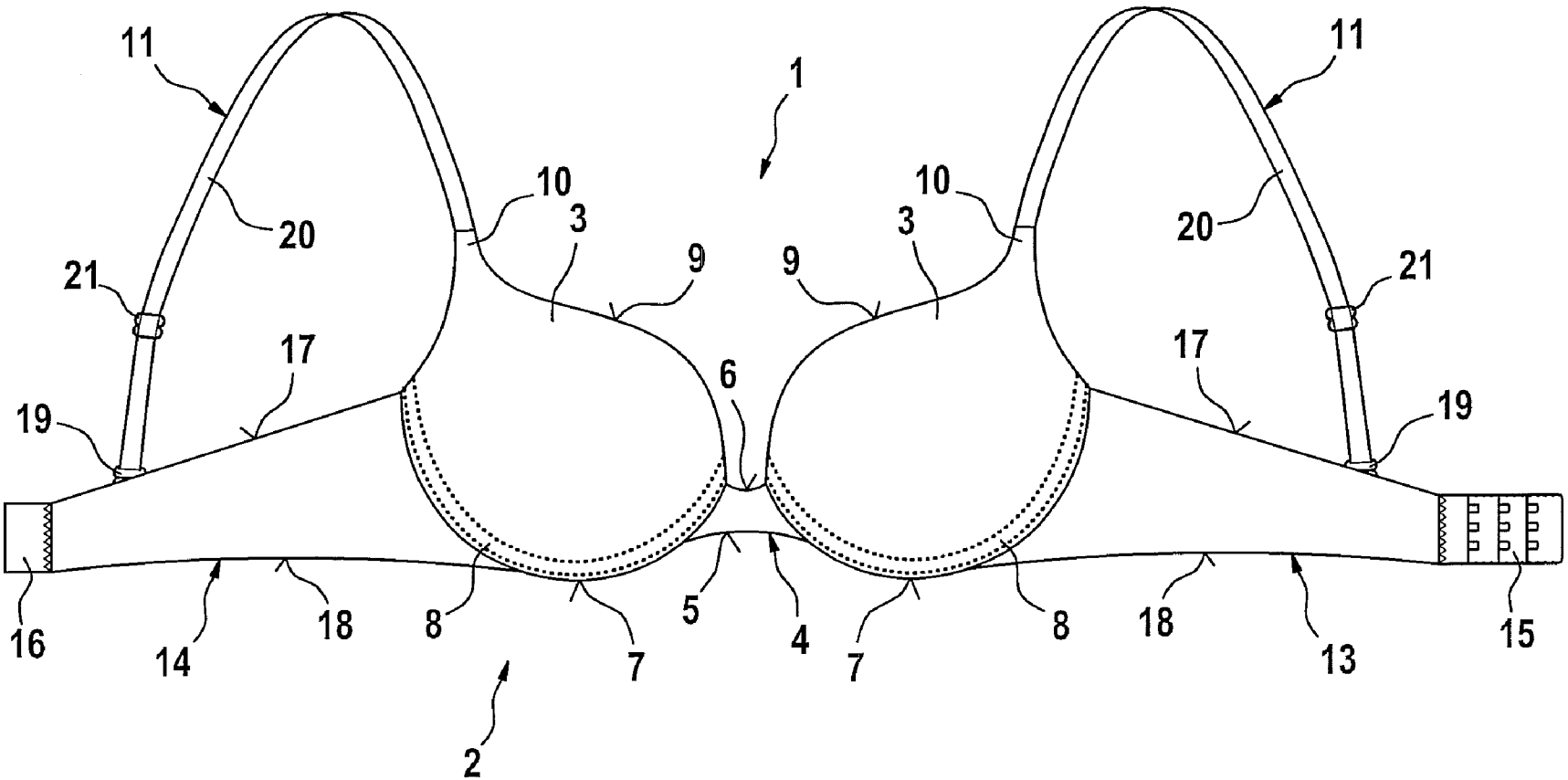
FIG. 1 is a front view of a brassiere according to the invention.

FIGS. 1 and 2 illustrate a brassiere 1 of the present invention in a view from the front to the inside. The brassiere 1 is comprised of a front section 2 having two bra cups 3 to accommodate the bust. The bra cups 3 can be formed of a rubber foam core, which is covered with a textile material, both on the outside and the inside. The two bra cups 3 are connected to each other by a center part 4, which in the instant embodiment has a roughly trapezoidal shape. The base of the center part 4 thereby forms the lower edge 5, and the opposite side forms the upper edge 6 of the center part 4.

Extending along the lower edge 7 of the bra cups 3 is a narrow channel 8 for the accommodation of respective underwires. The opposite upper edge 9 of the bra cups 3 is curved, and with its tapered attachment pieces 10, provides connection points for shoulder strap 11.

Adjacent laterally to the lower edge 7 of bra cups 3 is a side panel 13, 14, respectively, whereby at its free end, side panel 13 is provided with an eyelet 15, and the other side panel 14 is provided with a hook band 16. In combination, eyelet 15 and hook band 16 form a back closure.

The side panels 13 and 14 have an upper edge 17 and a lower edge 18, whereby near the eyelet 15 and the hook band 16, respectively, an attachment piece 19 for fastening the rearward part of the shoulder strap 11 is arranged. The support strap 20 of the shoulder strap 11 connecting the attachment piece 10 and the attachment piece 19 is of adjustable length. For this purpose, a buckle 21 is slid onto the strap 20. The end of strap 20 is threaded through the attachment piece 19 thus forming a loop, and returned to buckle 21, where it is being secured.

The contour line of brassiere 1 is thus defined by edges 5 and 6 of center part 4 and 9 of the bra cups 3, the upper and lower edges 17, 18, of the side panels 12, 13, as well as the longitudinal borders of the two shoulder straps 11.

The detailed construction of these border areas is illustrated in FIGS. 3 to 6, which respectively show a cross section of a brassiere 1 of the present invention, as can be seen as an overall view in FIG. 2.

FIG. 3 corresponds thereby to a cross section of the center part 4. Essentially, the center part 4 is formed of a textile blank 22 of roughly trapezoidal shape, the upper edge 5 and lower edge 6 of which are formed by folding the border areas to the inside, and by fixing them into place in this position. In FIG. 3, the part of the textile blank 22 that was folded in, is indicated with reference numeral 23 for the upper foldover, and is indicated with reference numeral 24 for the lower foldover.

The foldovers 23 and 24 are respectively fixed into position by an adhesive tape 25, which is supplied with a thermosensitive adhesive. The adhesive tape 25 is positioned between foldovers 23 and 24, respectively, and the textile blank 22. By applying pressure and heat, an intensive bonding of foldovers 23, 24, with the remaining textile blank 22 occurs.

It is also possible to apply the adhesive tape 25 initially to the corresponding border areas of the textile blank 22, then fold the border area over and fix the foldovers 23, 24, into position by heat and pressure.

FIG. 4 shows a partial cross section of a brassiere 1 of the present invention in the area of the upper edge 9 of bra cups 3. Illustrated is the convergence in the border area of the outer layer 26 and inner layer 27 of bra cups 3, which in the pocket thus created can accommodate foamed material (not shown) for shaping and supporting the bust.

In the border area, the outer layer 26 is folded over the upper edge 9 of bra cup 3, and thus forms a foldover 28 on the inside of bra cup 3. In order to permanently fix the border area into position, a thermosensitive adhesive band 25 is likewise placed between foldover 28 and the inner layer 27, and the bonding is accomplished by applying pressure and heat.

FIG. 5 illustrates a cross section of the side panel 14, which in its design is identical with side panel 13. Essentially, side panels 13 and 14 are one-layered so that the application of the invention in the area of side panels 13 and 14 basically corresponds to the procedure described in FIG. 3.

At their upper edge 17 and their lower edge 18, the border areas of side panels 13, 14, are folded in, thus forming foldovers 29 and 30. In order to fix the foldovers 29 and 30 into position, a thermosensitive adhesive band 25 is likewise placed between the foldovers 29, 30, and the side panel 13, 14, and is bonded therewith by applying pressure and heat.

A variation of this embodiment of the invention is illustrated in FIG. 6, which shows a cross section of a shoulder strap 11. Along its longitudinal edges, the support strap 20 of the shoulder strap 11 is folded over twice with a foldover 31, which connects directly with the longitudinal edge, and an additional foldover 32, which is folded inwardly in the area between foldover 31 and support strap 20.

In order to fix the two foldovers 31 and 32 into position, again a thermosensitive adhesive tape 25 is arranged between the inner side of the support strap 20 and the opposing side of foldover 32. By applying pressure and heat, a permanent bond between support strap 20 and foldovers 32 is obtained.

The benefit of this embodiment is that no free cutting edges are visible along the longitudinal edges of the shoulder straps 11. The result is a particularly advantageous aesthetic look so that a border design such as this is primarily applied in the visible areas of a brassiere 1 of the present invention. However, it goes without saying that this embodiment can also be realized in other parts of the brassiere 1, for example, in the areas shown in FIGS. 3 to 5.

The invention is not limited to the exemplary embodiment illustrated in the drawings, but also includes embodiments, which correspond with the object and purpose of the patent claims. For example, the term "brassiere" comprises all women's intimate apparel with built-in bust support, including bikini tops, swimsuits, and bodysuits.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed:

1. A brassiere comprising:

a front section that includes two bra cups;

two side panels configured to encircle an upper body of a person wearing the brassiere, first ends of each of said side panels attached to the front section, and second ends of each of said side panels configured to be joined together at a back of the person along a rearward part of said side panels, shoulder straps that extend from the bra cups to said rearward part of each of the side panels, wherein at least part of the brassiere is constructed of a single textile layer, and an edge of said single textile layer of the brassiere forming an exterior side is folded over upon itself to form a border edge, and is fixed into place in this position by means of an adhesive layer arranged between the folded over textile layer border foldover and an opposing textile layer side of the brassiere.

2. The brassiere according to claim 1, wherein the border foldover, which is fixed in place by an adhesive layer, extends along an upper edge of the bra cups, and/or lateral edges of the bra cups.

3. The brassiere according to claim 1, wherein the adhesive layer is a thermosensitive material, which can be activated by applying pressure and heat.

4. The brassiere according to claim 1, wherein the adhesive layer is applied directly to a border zone of the brassiere by a spray, roll, or pressure procedure.

5. The brassiere according to claim 1, wherein the adhesive layer is applied to an adhesive tape, which is positioned between said border foldover and said opposing side of the brassiere to fix the border foldover into place.

6. The brassiere according to claim 5, wherein the adhesive tape has elastic properties.

7. The brassiere according to claim 1, wherein the adhesive layer is a polyutherane, a polyolefin, or a thermoplastic elastomer.

8. The brassiere according to claim 1, wherein the border foldover is formed by folding it from both top and bottom directions.

9. A brassiere comprising:

a front section that includes two bra cups;

two side panels configured to encircle an upper body of a person wearing the brassiere, first ends of each of said side panels attached to the front section, and second ends of each of said side panels configured to be joined together at a back of the person along a rearward part of said side panels, shoulder straps that extend from the bra cups to said rearward part of each of the side panels, wherein said bra cups are comprised of inner and exterior textile layers, at least part of a border of the bra cups is constructed such that the exterior textile layer of the brassiere forming an exterior side is folded over an edge of said inner textile layer to form a border edge, and is fixed into place in this position by means of an adhesive layer arranged between the folded over exterior textile layer and an opposing textile layer.

10. The brassiere according to claim 9, wherein the border foldover, which is fixed in place by an adhesive layer, extends along an upper edge of the bra cups, and/or the lateral edges of the bra cups.

11. The brassiere according to claim 9, wherein the adhesive layer is a thermosensitive material, which can be activated by applying pressure and heat.

12. The brassiere according to claim 9, wherein the adhesive layer is applied directly to a border zone of the brassiere by a spray, roll, or pressure procedure.

13. The brassiere according to claim 9, wherein the adhesive layer is applied to an adhesive tape, which is positioned between said border foldover and said opposing side of the brassiere to fix the border foldover into place.

14. The brassiere according to claim 13, wherein the adhesive tape has elastic properties.

15. The brassiere according to claim 9, wherein the adhesive layer is a polyutherane, a polyolefin, or a thermoplastic elastomer.

* * * * *